US007485402B2

(12) United States Patent
Arai et al.

(10) Patent No.: US 7,485,402 B2
(45) Date of Patent: Feb. 3, 2009

(54) HEAT-SENSITIVE TRANSFER IMAGE-RECEIVING SHEET AND METHOD FOR PRODUCING HEAT-SENSITIVE TRANSFER IMAGE-RECEIVING SHEET

(75) Inventors: Takuya Arai, Kanagawa (JP); Yoshio Ishii, Kanagawa (JP); Yoshihisa Tsukada, Kanagawa (JP); Toshihide Yoshitani, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/711,788

(22) Filed: Feb. 28, 2007

(65) Prior Publication Data

US 2007/0202277 A1 Aug. 30, 2007

(30) Foreign Application Priority Data

Feb. 28, 2006 (JP) ..... 2006-051698

(51) Int. Cl.
*G03C 8/00* (2006.01)
*B41M 5/40* (2006.01)

(52) U.S. Cl. ..... 430/201; 430/941; 428/32.5

(58) Field of Classification Search ..... 430/201, 430/941; 428/32.5

See application file for complete search history.

(56) References Cited

U.S. PATENT DOCUMENTS

| | | | | | |
|---|---|---|---|---|---|
| 5,017,823 | A * | 5/1991 | Okumura | 310/323.05 |
| 5,071,823 | A * | 12/1991 | Matsushita et al. | 503/227 |
| 5,350,198 | A | 9/1994 | Bernecker | |
| 7,223,513 | B2 * | 5/2007 | Nakane et al. | 430/200 |
| 2004/0121257 | A1 * | 6/2004 | Kaminsky et al. | 430/201 |

FOREIGN PATENT DOCUMENTS

| | | | |
|---|---|---|---|
| EP | 545893 | * | 9/1993 |
| JP | 2-89690 | A | 3/1990 |
| JP | 5-193256 | A | 8/1993 |
| JP | 5-229289 | A | 9/1993 |
| JP | 9-131972 | A | 5/1997 |
| JP | 11-321128 | A | 11/1999 |

* cited by examiner

*Primary Examiner*—Geraldina Visconti
(74) *Attorney, Agent, or Firm*—Sughrue Mion, PLLC

(57) ABSTRACT

A heat-sensitive transfer image-receiving sheet comprising at least one receiving layer containing a polymer latex and at least one heat insulating layer containing a hollow polymer on a support, wherein the polymer latex contained in the receiving layer comprises two or more dyable polymers having different glass transition temperatures.

16 Claims, No Drawings

HEAT-SENSITIVE TRANSFER IMAGE-RECEIVING SHEET AND METHOD FOR PRODUCING HEAT-SENSITIVE TRANSFER IMAGE-RECEIVING SHEET

BACKGROUND OF THE INVENTION

1. Field of the Invention

The present invention relates to a heat-sensitive transfer image-receiving sheet and a method for producing the same and more particularly to a heat-sensitive transfer image-receiving sheet capable of providing a good image having a high density and little image defects in a short time processing and a method for producing the same.

2. Description of the Related Art

Various heat-sensitive transfer recording methods have been heretofore known. In particular, a dye dispersion transfer recording method has been noted as a process capable of preparing a color hard copy having the closest image quality to silver salt photograph (see "Joho Kiroku (haado kopi) to sono zairyouno shintenkai (New Development of Data Recording (hard copy) and Its Materials)", Toray Research Center, 1993, pp. 241-285, and "Purinta Zairyou no Kaihatsu (Development of Printer Materials)", CMC, 1995, page 180). Further, this dye dispersion transfer recording method is advantageous in that it can be operated in a dry process as compared with silver salt photography and allows direct visualization from digital data that facilitates reproduction.

In the dye dispersion transfer recording method, a heat-sensitive transfer sheet containing a dye (hereinafter referred to as "ink sheet") and a heat-sensitive transfer image-receiving sheet (hereinafter referred to as "image-receiving sheet") are laminated on each other. Subsequently, the ink sheet is heated by a thermal head which is controlled in heat generation by an electric signal so that the dye in the ink sheet is transferred to the image-receiving sheet to make recording of image data. Cyan, magenta and yellow colors are then recorded imposed on each other to make transfer recording of a color image having a continuous color density change.

The image-receiving sheet to be used in this process comprises a receiving layer formed on a support for receiving a dye which has been transferred. In general, in order to enhance the adhesion between the image-receiving sheet and the ink sheet, a layer having a high cushioning effect such as foaming layer made of a resin and a foaming agent and a porous layer containing a hollow polymer is formed between the support and the receiving layer.

For example, JP-A-11-321128 discloses that the spreading and drying of an interlayer comprising a hollow particulate material and an organic solvent-resistant polymer as main components on a support is followed by the formation of a receiving layer by an organic solvent-based resin coating solution. The organic solvent-resistant polymer to be incorporated in the interlayer acts to prevent the hollow particulate material incorporated in the interlayer from being dissolved in the organic solvent in the receiving layer. However, the heat-sensitive transfer image-receiving sheet comprising a receiving layer formed by an organic solvent-based resin coating solution is disadvantageous in that it has an insufficient sensitivity and a raised cost. The heat-sensitive transfer image-receiving sheet has been desired to have improvement also in image quality and transfer density.

JP-A-2-89690 discloses a heat-sensitive transfer image-receiving sheet comprising a layer having a hollow spherical pigment dispersed therein and an image-receiving layer (receiving layer). However, this heat-sensitive transfer image-receiving sheet is disadvantageous in that the image obtained after transfer undergoes bleeding.

Further, JP-A-5-193256, JP-A-5-229289 and JP-A-9-131972 each disclose a heat-sensitive transfer image-receiving sheet having a receiving layer comprising a vinyl chloride-based copolymer. However, further improvements have been desired from the standpoint of the recent market's requirement for enhancement of processing speed.

SUMMARY OF THE INVENTION

An object of the invention is to provide a heat-sensitive transfer image-receiving sheet capable of providing a good image having a high density and little image defects in a short time processing and a method for producing the same.

As a result of extensive studies made by the present inventors, the following inventions were provided as means for solving the aforementioned problems.

(1) A heat-sensitive transfer image-receiving sheet comprising at least one receiving layer containing a polymer latex and at least one heat insulating layer containing a hollow polymer on a support, wherein the polymer latex contained in the receiving layer comprises two or more dyable polymers having different glass transition temperatures.

(2) The heat-sensitive transfer image-receiving sheet as defined in Clause (1), wherein among the two or more polymer latexes contained in the receiving layer, the polymer latex having the lowest glass transition temperature has a glass transition temperature of 0° C. to 60° C. and the polymer latex having the highest glass transition temperature has a glass transition temperature of 60° C. to 100° C.

(3) The heat-sensitive transfer image-receiving sheet as defined in Clause (1), wherein the weighted-averaged glass transition temperature of the at least two polymer latexes contained in the receiving layer is from 40° C. to 70° C.

(4) The heat-sensitive transfer image-receiving sheet as defined in Clause (1) or (2), wherein the receiving layer comprises a copolymer containing a repeating unit derived from vinyl chloride.

(5) The heat-sensitive transfer image-receiving sheet as defined in any one of Clauses (1) to (4), wherein the heat insulating layer containing a hollow polymer is free of resin having no resistance to organic solvents besides the hollow polymer.

(6) The heat-sensitive transfer image-receiving sheet as defined in any one of Clauses (1) to (5), wherein the receiving layer and/or heat insulating layer contains a water-soluble polymer.

(7) The heat-sensitive transfer image-receiving sheet as defined in Clause (6), wherein the receiving layer and/or heat insulating layer containing a water-soluble polymer contains a compound capable of crosslinking the water-soluble polymer and the water-soluble polymer is partly or entirely crosslinked.

(8) A method for producing a heat-sensitive transfer image-receiving sheet comprising simultaneously spreading at least one receiving layer coating solution containing a polymer latex made of two or more dyable polymers having different glass transition temperatures and at least one heat insulating layer coating solution containing a hollow polymer but free of resin having no resistance to organic solvents excluding the hollow polymer over a support in this order to form at least one receiving layer and at least one heat insulating layer on the support.

The use of the heat-sensitive transfer image-receiving sheet of the invention makes it possible to obtain a good image having a high transfer density and little image defects in a short time processing. Further, the incorporation of a water-soluble polymer and a compound capable of crosslinking the water-soluble polymer in the receiving layer and/or heat insulating layer of the heat-sensitive transfer image-receiving sheet of the invention makes it possible to crosslink partly or entirely the water-soluble polymer. The resulting heat-sensitive transfer image-receiving sheet has enhanced film strength and conveyability.

Further, when the heat-sensitive transfer image-receiving sheet is produced by a simultaneous multi-layer coating method according to the production method of the invention, image defects can be further eliminated.

BEST MODE FOR CARRYING OUT THE INVENTION

The heat-sensitive transfer image-receiving sheet and the method for producing the heat-sensitive transfer image-receiving sheet of the present invention will be further described hereinafter. The following descriptions of the constituent requirements are occasionally made on the basis of representative embodiments of the present invention, but the present invention is not limited thereto. The numerical range represented by the term " to " include the numerical values set forth before and after "to" as lower and upper limits, respectively.

(Layer Configuration of Heat-Sensitive Transfer Image-Receiving Sheet)

The heat-sensitive transfer image-receiving sheet of the present invention comprises at least one receiving layer (dye receiving layer) provided on a support and at least one heat insulating layer (porous layer) provided between the support and the receiving layer. An underlayer such as whiteness adjusting layer, charge adjusting layer, adhesive layer and primer layer may be provided between the receiving layer and the heat insulating layer.

The receiving layer and the heat insulating layer are preferably formed by a simultaneous multi-layer coating method. In the case where the underlayer is included, the receiving layer, the underlayer and the heat insulating layer may be formed by a simultaneous multi-layer coating method.

The support preferably has a curl adjusting layer, a writing layer and a charge adjusting layer formed on the back side thereof. Each layer can be coated by an ordinary method such as roll coating method, bar coating method, gravure coating method and gravure reverse coating method.

(Receiving Layer)

The receiving layer acts to receive dyes which have moved from the ink sheet and maintain the image thus formed. In the image-receiving sheet of the present invention, the receiving layer contains a polymer latex. The receiving layer may be composed of a single layer or two or more layers. The receiving layer preferably contains a water-soluble polymer described later.

<Polymer Latex>

The polymer latex to be used in the present invention will be further described below. In the heat-sensitive transfer image-receiving sheet of the present invention, the polymer latex to be incorporated in the receiving layer is a dispersion of a hydrophobic polymer in a water-soluble medium as particulate material. Referring to the state of dispersion, the particulate polymer may be emulsified, emulsion-polymerized or micelle-dispersed in the dispersion medium. Alternatively, the polymer molecule may have a partial hydrophilic structure so that the molecular chain itself is molecularly dispersed. For the details of polymer latexes to be used herein, reference can be made to Taira Okuda and Hiroshi Inagaki, "Gousei Jushi Emarujon (Synthetic Resin Emulsion)", Kobunshi Kankoukai, 1978, Takaaki Sugimura, Haruo Kataoka, Soichi Suzuki, Keiji Kasaharam "Gosei Ratekkusu no Oyo (Application of Synthetic Latexes)", Kobunshi Kankoukai, 1993, Soichi Muroi, "Gosei Ratekkusu no Kagaku (Chemistry of Synthetic Latexes)", Kobunshi Kankoukai, 1970, Yoshiaki Miyosawa, "Suisei Kotingu Zairyo no Kaihatsu to Oyo (Development and Application of Aqueous Coating Materials)", CMC, 2004, JP-A-64-538, etc. The average particle size of the dispersed particles is preferably from about 1 nm to 50,000 nm, more preferably from about 5 nm to 1,000 nm.

The distribution of particle size of dispersed particles is not specifically limited. The dispersed particles may have a broad particle size distribution or a monodisperse particle size distribution.

The polymer latex may be one having an ordinary uniform structure or so-called core/shell latex. In this structure, it may be advantageous that the core and the shell have different glass transition temperatures. The glass transition temperature of the polymer latex in this case is preferably from −30° C. to 100° C., more preferably from 0° C. to 90° C., even more preferably from 10° C. to 80° C., and particularly preferably from 20° C. to 75° C.

In the invention, the polymer latex to be incorporated in the receiving layer is made of two or more dyable polymers having different glass transition temperatures. The term "dyable polymer" as used herein is meant to indicate a polymer which can receive a dye transferred from the ink sheet and be dyed with the dye. Preferably, among the two or more polymer latexes to be incorporated in the receiving layer, the polymer latex having the lowest glass transition temperature has a glass transition temperature of 0° C. to 60° C. (more preferably of 10° C. to 50° C.) and the polymer latex having the highest glass transition temperature has a glass transition temperature of 60° C. to 100° C. (more preferably of 60° C. to 80° C.). The difference in glass transition temperature between these polymer latexes is preferably 1° C. to 100° C., more preferably 10° C. to 70° C.

The two or more polymer latexes having different glass transition temperatures to be used in the invention preferably have a weighted-averaged glass transition temperature (Tg) of −30° C. to 120° C., more preferably of −10° C. to 100° C., even more preferably of 0° C. to 90° C. from the standpoint of work brittleness and image storage properties. In the invention, the weighted-averaged glass transition temperature of the polymer latex is most preferably 40° C. to 70° C.

The term "weighted-averaged glass transition temperature" as used herein is meant to indicate the glass transition temperature obtained by weighted-averaging the glass transition temperatures of the various polymers constituting the two or more polymer latexes taking into account the mass of the various polymer latexes (e.g., mass of blend). In the case where phase separation occurs or the polymer latex has a core-shell structure, weighted-averaged Tg preferably falls within the above defined range.

The glass transition temperature (Tg) can be calculated by the following formula.

$$1/Tg=\Sigma(Xi/Tgi)$$

wherein the polymer is obtained by the copolymerization of monomer components in a number of n (i=1 to n). Xi represents the mass fraction of i-th monomer (ΣXi=1). Tgi represents the glass transition temperature (absolute temperature)

of homopolymer of i-th monomer. Σ represents the sum of (Xi/Tgi) from i of 1 to n. For the glass transition temperature (Tgi) of homopolymer of the various monomers, reference can be made to J. Brandrup, E. H. Immergut, "PolymerHandbook (3rd Edition)", Wiley-Interscience, 1989.

Preferred examples of the polymer latex to be used in the invention include polylactic acid esters, polyurethanes, polycarbonates, polyesters, polyacetals, SBR, and polyvinyl chlorides. Preferred among these polymer latexes are polyesters, polycarbonates, and polyvinyl chlorides. Most desirable are copolymers containing a repeating unit derived from vinyl chloride.

Examples of the polymer latexes to be used in the invention other than the above exemplified polymer latexes include the following polymer latexes. The aforementioned polymer latexes may be used in combination with other polymers.

The polymer latexes other than those exemplified above are preferably transparent or semitransparent and colorless. Examples of these polymer latexes include natural resins, polymers or copolymers, synthetic resins, polymers or copolymers or other film-forming media, e.g., gelatins, polyvinyl alcohols, hydroxyethyl celluloses, cellulose acetates, cellulose acetate butyrates, polyvinylpyrrolidones, casein, starch, polyacrylic acids, polymethyl methacrylates, polyvinyl chlorides, polymethacrylic acids, styrene-maleic anhydride copolymers, styrene-acrylonitrile copolymers, styrene-butadiene copolymers, polyvinyl acetals (e.g., polyvinyl formal and polyvinyl butyral), polyesters, polyurethanes, phenoxy resins, polyvinylidene chlorides, polyepoxides, polycarbonates, polyvinyl acetates, polyolefins, and polyamides. The binder may be formed by coating of water, an organic solvent or emulsion.

The polymer latex to be incorporated in the receiving layer of the invention preferably contains a copolymer containing as a monomer unit a polyvinyl chloride or vinyl chloride (e.g., vinyl chloride-vinyl acetate copolymer, and vinyl chloride-acryl copolymer). In this case, the proportion of the vinyl chloride monomer is preferably from 50% to 95%. These polymers may be straight-chain polymers, branched polymers, crosslinked polymers, so-called homopolymers obtained by polymerization of single monomer or copolymers obtained by polymerization of two or more monomers. In the case where the polymers are copolymers, they may be random copolymers or block copolymers. These copolymers each have a number-average molecular weight of 5,000 to 100,000, preferably 10,000 to 500,000. When the molecular weight of these copolymers is too small, the dynamic strength of the layer containing the polymer latex is insufficient. On the other hand, when the molecular weight of these copolymers is too great, the polymer latex may have deteriorated film-forming properties. Further, crosslinkable polymer latexes are preferably used in the invention.

The polymer latexes which can be used in the invention are commercially available. The following polymers can be used. Examples of polyvinyl chlorides employable herein include G351 and G576 (produced by ZEON CORPORATION), and Vinyblan 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938 and 950 (produced by NISSIN CHEMICAL INDUSTRY CO., LTD.) (All these compounds are represented by trade name). Examples of polyesters include Vylonal MD-1100, MD-1200, MD-1245 and MD-1480 (produced by TOYOBO CO., LTD.), and PLASCOAT Z221, Z446, Z561, Z450, Z565, RZ105 and Z730 (produced by GOO CHEMICAL CO., LTD.) (All these compounds are represented by trade name).

These polymer latexes may be used singly or in a blend of two or more thereof as necessary.

In the heat-sensitive transfer image-receiving sheet of the invention, the proportion of the copolymer latex containing vinyl chloride as a monomer unit in the total solid content of the receiving layer is preferably 50% by mass or more.

In the present invention, the receiving layer is preferably prepared by spreading an aqueous coating solution, and then drying the coat. The term "aqueous" as used herein is meant to indicate that 60% by mass or more of the solvent (dispersant) in the coating solution is composed of water. Examples of components of the coating solution other than water include water-miscible organic solvents such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether and oxyethylphenyl ether.

The lowest film-forming temperature (MFT) of the polymer latex is preferably from about −30° C. to 90° C., more preferably from about 0° C. to 70° C. In order to control the lowest film-forming temperature of the polymer latex, the polymer latex may comprise a film-forming aid incorporated therein. The film-forming aid is also called a temporary plasticizer and is an organic compound (normally in the form of organic solvent) which lowers the lowest film-forming temperature of the polymer latex. The film-forming aid is described in, e.g., Soichi Muroi, "Gosei Ratekkusu no Kagaku (Chemistry of Synthetic Latexes)", Kobunshi Kankokai, 1970. Preferred examples of the film-forming aid include the following compounds, but the compounds employable herein are not limited to the following specific examples.

Z-1: Benzyl alcohol

Z-2: 2,2,4-Trimethylpentanediol-1,3-monoisobutyrate

Z-3: 2-Dimethylaminoethanol

Z-4: Diethylene glycol

The polymer to be used in the binder of the present invention can be easily obtained by solution polymerization method, suspension polymerization method, emulsion polymerization method, dispersion polymerization method, anionic polymerization method, cationic polymerization method or the like. Most desirable among these polymerization methods is emulsion polymerization because the polymer can be obtained in the form of latex. Also, a method is preferably used which comprises preparing a polymer in a solution, neutralizing the polymer or adding an emulsifier to the polymer, adding water to the polymer, and then forcedly stirring the mixture to prepare an aqueous dispersion. The emulsion polymerization is carried out by allowing a mixture of a dispersing medium such as water or a mixture thereof with a water-miscible organic solvent (e.g., methanol, ethanol, acetone) with a monomer in an amount of from 5% to 150% by mass based on the amount of the dispersing medium to undergo polymerization with stirring in the presence of an emulsifier and a polymerization initiator preferably based on the total amount of the monomers at a temperature of from about 30° C. to 100° C., particularly preferably from 60° C. to 90° C. for 3 to 24 hours. The various conditions such as the kind of dispersant to be used, the monomer concentration, the amount of initiator, the amount of emulsifier, the amount of dispersant, the reaction temperature and the method for adding monomer may be properly predetermined taking into account the kind of the monomers used. It is also preferred that a dispersant be used as necessary.

The emulsion polymerization can be normally carried out by the method disclosed in Taira Okuda and Hiroshi Inagaki, "Gousei Jushi Emarujon (Synthetic Resin Emulsion)", Kobunshi Kankoukai, 1978, Takaaki Sugimura, Haruo Kataoka, Soichi Suzuki, Keiji Kasaharam "Gosei Ratekkusu no Oyo (Application of Synthetic Latexes)", Kobunshi Kankoukai, 1993, Soichi Muroi, "Gosei Ratekkusu no Kagaku (Chemistry of Synthetic Latexes)", Kobunshi Kankoukai, 1970, etc. As the emulsion polymerization method for synthesizing the polymer latex to be used in the present invention there may be selected collective polymerization method, monomer addition (continuous or batchwise) method, emulsion addition method, seed polymerization method, etc. Preferred among these polymerization methods from the standpoint of productivity of latex are collective polymerization method, monomer addition (continuous or batchwise) method and emulsion addition method.

As the aforementioned polymerization initiator there may be used any polymerization initiator capable of generating radicals. Examples of the polymerization initiator employable herein include inorganic peroxides such as persulfate and hydrogen peroxide, peroxides as disclosed in a catalog of organic peroxides published by NOF CORPORATION, and azo compounds as disclosed in a catalog of azo polymerization initiator published by Wako Pure Chemical Industries, Ltd. Preferred among these polymerization initiators are water-soluble peroxides such as persulfate and water-soluble azo compounds as disclosed in a catalog of azo polymerization initiator published by Wako Pure Chemical industries, Ltd. More desirable among these polymerization initiators are ammonium persulfate, sodium persulfate, potassium persulfate, azobis(2-methylpropionamizine)hydrochloride, azobis(2-methyl-N-(2-hydroxyethyl)propionamide) and azobiscyanovaleric acid. Particularly preferred among these polymerization initiators are persulfates such as ammonium persulfate, sodium persulfate and potassium persulfate from the standpoint of image storage properties, solubility and cost.

The amount of the aforementioned polymerization initiator to be added is preferably from 0.3% to 2.0% by mass, more preferably from 0.4% to 1.75% by mass, particularly preferably from 0.5% to 1.5% by mass based on the total amount of the monomers.

As the aforementioned polymerization emulsifier there may be used any of anionic surface active agents, nonionic surface active agents, cationic surface active agents and amphoteric surface active agents. Preferred among these polymerization emulsifiers are anionic surface active agents from the standpoint of dispersibility and image storage properties. More desirable among these anionic surface active agents are sulfonic acid type anionic surface active agents because they can be used in a small amount to assure polymerization stability and have hydrolyzation resistance. Even more desirable among these sulfonic acid type anionic surface active agents are long-chain alkyldiphenyletherdisulfonic acid such as PELEX SS-H (trade name; produced by Kao Corporation). Particularly desirable are low electrolyte type such as Pionin A-43-S (trade name; produced by TAKEMOTO OIL & FAT Co., Ltd.).

As the aforementioned polymerization emulsifier there is preferably used a sulfonic acid type anionic surface active agent in an amount of from 0.1 to 10.0% by mass, more preferably from 0.2% to 7.5% by mass, particularly preferably from 0.3% to 5.0% by mass based on the total amount of the monomers.

For the synthesis of the polymer latex to be used in the present invention, a chelating gent is preferably used. A chelating agent is a compound capable of chelating polyvalent ions such as metal ion, e.g., ferric or ferrous ion and alkaline earth metal ion, e.g., calcium ion. Examples of the chelating agent employable herein include compounds as disclosed in JP-B-6-8956, U.S. Pat. No. 5,053,322, JP-A-4-73645, JP-A-4-127145, JP-A-4-247073, JP-A-4-305572, JP-A-6-11805, JP-A-5-173312, JP-A-5-66527, JP-A-5-158195, JP-A-6-118580, JP-A-6-110168, JP-A-6-161054, JP-A-6-175299, JP-A-6-214352, JP-A-7-114161, JP-A-7-114154, JP-A-7-120894, JP-A-7-199433, JP-A-7-306504, JP-A-9-43792, JP-A-8-314090, JP-A-10-182571, JP-A-10-182570, JP-A-11-190892, and JP-A-11-190892.

Preferred examples of the aforementioned chelating agents employable herein include inorganic chelate compounds (e.g., sodium tripolyphosphate, sodium hexamethaphosphate, sodium tetrapolyphosphate), aminopolycarboxylic acid-based chelate compounds (e.g., nitrilotriacetic acid, ethylenediaminetetraacetic acid), organic phosphonic acid-based chelate compounds (e.g., compounds disclosed in Research Disclosure No. 18170, JP-A-52-102726, JP-A-53-42730, JP-A-56-97347, JP-A-54-121127, JP-A-55-4024, JP-A-55-4025, JP-A-55-29883, JP-A-55-126241, JP-A-55-65955, JP-A-55-65956, JP-A-57-179843, JP-A-54-61125, West German Patent 1045373), polyphenolic chelating agents, and polyamine-based chelate compounds. Particularly preferred are aminopolycarboxylic acid derivatives.

Preferred examples of the aforementioned aminopolycarboxylic acid derivatives employable herein include compounds set forth in the attached table in "EDTA (-Chemistry of Complexanes)", Nankodo, 1977. Further examples of the aminopolycarboxylic acid derivatives include those obtained by substituting some of carboxylic groups in the above exemplified compounds by salt of alkaline metal such as sodium and potassium or ammonium salt or the like. Particularly preferred examples of the aminopolycarboxylic acid derivative employable herein include iminodiacetic acid, N-methyl iminodiacetic acid, N-(2-aminoethyl)iminodiacetic acid, N-(carbamoylmethyl)iminodiacetic acid, nitrilotriacetic acid, ethylenediamine-N,N'-diacetic acid, ethylenediamine-N,N'-di-α-propionic acid, ethylenediamine-N,N'-di-β-propionic acid, N,N'-ethylene-bia(α-o-hydroxyphenyl)glycine, N,N'-di(2-hydroxybenzyl)ethylenediamine-N,N'-diacetic acid, ethylenediamine-N,N'-diacetic acid-N,N'-diaceto hydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,1-2,3-diaminobutane-N,N,N'N'-tetraacetic acid, meso-2,3-diaminobutane-N,N,N',N'-tetraacetic acid, 1-phenylethylenediamine-N,N,N',N'-tetraacetic acid, d,1-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetracetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis(ethyliminodiacetic acid), 2,2'-ethylenedioxy-bis(ethyliminodiacetic acid), ethylenediamine-N,N'-diacetic acid-N,N'-di-β-propionic acid, ethylenediamine-N,N'-diacetic acid-N,N'-di-β-propionic acid, ethylenediamine-N,N,N',N'-tetrapropionic acid, diethylenetriamine-N,N,N',N'',N''-pentaacetic acid, triethylenetetramine-N,N,N',N'',N''',N'''-hexaacetic acid, and 1,2,3-triaminopropane-N,N,N',N'',N''',N'''-hexaacetic acid. Further examples of the aminopolycarboxylic acid derivative employable herein include those obtained by substituting some of carboxylic groups in the above exemplified compounds by salt of alkaline metal such as sodium and potassium with ammonium or the like.

The amount of the aforementioned chelating agent to be added is preferably from 0.01% to 0.4% by mass, more preferably from 0.02% to 0.3% by mass, particularly preferably from 0.03% to 0.15% by mass based on the total amount of the monomers. When the amount of the chelating agent to be added falls below 0.01% by mass, the metallic ions which have entered at the step of producing the polymer latex cannot be sufficiently caught, causing the drop of stability of latex to agglomeration and hence the deterioration of spreadability. On the other hand, when the amount of the chelating agent to be added exceeds 0.4% by mass, the resulting latex sometimes exhibits a raised viscosity and hence a deteriorated spreadability.

The synthesis of the polymer latex to be used in the present invention is preferably effected in the presence of a chain transfer agent. As such a chain transfer agent there is preferably used one disclosed in "Polymer Handbook, 3rd edition", Wiley-Interscience, 1989. Sulfur compounds are more desirable because they have a high chain transfer capability and thus can be used in a small amount. Particularly desirable are hydrophobic mercaptane-based chain transfer agents such as tert-dodecylmercaptane and n-dodecylmercaptane.

The amount of the aforementioned chain transfer agent to be added is preferably from 0.2% to 2.0% by mass, more preferably from 0.3% to 1.8% by mass, particularly preferably from 0.4% to 1.6% by mass based on the total amount of the monomers.

For the emulsion polymerization, additives as disclosed in handbook of synthetic rubbers such as electrolyte, stabilizer, thickening agent, anti-foaming agent, oxidation inhibitor, vulcanizing agent, antifreezing agent, gelatinizing agent and vulcanization accelerator may be used besides the aforementioned compounds.

As the solvent to be used in the coating solution of the polymer latex of the invention there may be used an aqueous solvent. However, a water-miscible organic solvent may be used in combination with the aqueous solvent. Examples of the water-miscible organic solvent employable herein include alcohol-based solvents such as methyl alcohol, ethyl alcohol and propyl alcohol, cellosolve-based solvents such as methyl cellosolve, ethyl cellosolve and butyl cellosolve, ethyl acetate, and dimethylformamide. The amount of these organic solvents to be added is preferably 50% by mass or less, more preferably 30% by mass or less based on the amount of the solvents.

Referring further to the polymer latex to be used in the present invention, the concentration of polymers in the latex solution is preferably from 10% to 70% by mass, more preferably from 20% to 60% by mass, particularly preferably from 30% to 55% by mass.

The polymer latex in the image-receiving sheet of the present invention is partially in the form of gel or dried film formed by drying part of the solvents after spreading.

<Water-Soluble Polymer>

The receiving layer preferably comprises a water-soluble polymer incorporated therein, The water-soluble polymer is defined as a polymer in which the solubility to 100 g of water at 20° C. is at least 0.05 g, preferably at least 0.1 g, more preferably at least 0.5 g. Examples of the water-soluble polymer employable herein include natural polymers (e.g., polysaccharide-based polymers, microorganism-based polymers, animal-based polymers), semisynthetic polymers (e.g., cellulose-based polymers, starch-based polymers, alginic acid-based polymers), and synthetic polymers (e.g., vinyl-based polymers). The synthetic polymers such as polyvinyl alcohol described below and natural or semisynthetic polymers made from plant-derived cellulose correspond to the water-soluble polymers which can be used in the present invention. The water-soluble polymers in the present invention don't include the aforementioned polymer latexes.

Among the water-soluble polymers which can be used in the present invention, the natural polymers and semisynthetic polymers will be further described below. Examples of the plant-based polysaccharides include gum arabic, κ-carrageenan, ι-carrageenan, λ-carrageenan, guar gum (Supercol, produced by Squalon Inc.), locust bean gum, pectine, traganth, corn starch (e.g., Purity-21, produced by National Starch & Chemical Co., Ltd.), and phosphate starch (e.g., 78-1898, produced by National Starch & Chemical Co., Ltd.). Examples of the microorganism-based polysaccharides include xanthane gum (e.g., Keltrol T, produced by Kelco Co., Ltd.), and dextrin (e.g., Nadex 360, produced by National Starch & Chemical Co., Ltd.). Examples of the animal-based natural polymers include gelatin (e.g., Crodyne B419, produced by Croda Co., Ltd.), casein, and sodium chondroitinsulfate (e.g., Cromoist CS, produced by Croda Co., Ltd.). (All these compounds are represented by trade name). Examples of the cellulose-based polymers include ethyl cellulose (e.g., Cellofas WLD, produced by I.C.I.), carboxymethyl cellulose (e.g., CMC, produced by Daicel Polymer Ltd.), hydroxyethyl cellulose (e.g., HEC, produced by Daicel Polymer Ltd.), hydroxypropyl cellulose (e.g., Aqualon, produced by Klucel Co., Ltd.), methyl cellulose (e.g., Viscontran, produced by Henkel Co., Ltd.), nitrocellulose (e.g., Isopropyl Wet, produced by Hercules Co., Ltd.), and cationated cellulose (e.g., Crodacel QM, produced by Croda Co., Ltd.). (All these compounds are represented by trade name). Examples of the starch-based polymers include phosphate starch (e.g., National 78-1898, produced by National Starch & Chemical Co., Ltd.). Examples of the alginate-based polymers include sodium alginate (e.g., Keltone, produced by Kelon Co., Ltd.), and propylene glycol alginate. Examples of other groups of polymers include cationated guar gum (e.g., Hi-care 1000, produced by Alcolac Co., Ltd.), and sodium hyaluronate (e.g., Hyalre, produced by Life Biomedical Co., Ltd.) (All these compounds are represented by trade name).

Preferred among the natural polymers and semisynthetic polymers which can be used in the present invention are gelatin. Among the gelatin which can be used in the present invention, the gelatin may have molecular weight of from 10,000 to 1,000,000. The gelatin may comprise anion like chloride ion or Sulfate ion. The gelatin may also comprise cation like ferrous ion, calcium ion, magnesium ion, tin ion, or zinc ion. The gelatin preferably prepared as a water solution.

Among the water-soluble polymers which can be used in the present invention, the synthetic polymers will be further described below. Examples of the acrylic polymers employable herein include sodium polyacrylates, polyacrylic acid copolymers, polyacrylamides, polyacrylamide copolymers, and quaternary salts of polydiethylaminoethyl(meth)acrylate and copolymers thereof. Examples of the vinyl-based polymers include polyvinypyrrolidones, polyvinylpyrrolidone copolymers, and polyvinyl alcohols. Other examples of the synthetic polymers include polyethylene glycols, polypropylene glycols, polyisopropyl acrylamides, polymethyl vinyl ethers, polyethyleneimines, polystyrenesulfonic acids, copolymers thereof, naphthalenesulfonic acid condensates, polyvinylsulfonic acids, copolymers thereof, polyacrylic acids, copolymers thereof, acrylic acids, copolymers thereof, maleic acid copolymers, maleic acid monoester copolymers, acryloylmethylpropanesulfonic acids, copolymers thereof, polydimethyldiallylammonium chlorides, copolymers thereof, polyamizines, copolymers thereof, polyimidazolines, dicyaneamide-based condensates, epichlorohydrin-dimethylamine condensates, Hoffman decomposition product of polyacrylamides, and water-soluble polyesters (e.g., Z-221, Z-446, Z-561, Z-450, Z-565, Z-850, z-3308, RZ-105, RZ-570, Z-730, RZ-142, produced by GOO CHEMICAL Co., LTD.) (All these compounds are represented by trade name).

High hygroscopicity polymers disclosed in U.S. Pat. No. 4,960,681, JP-A-62-245260, etc., i.e., homopolymer of vinyl monomers having —COOM or —$SO_3M$ (in which M represents a hydrogen atom or alkaline metal) or copolymers of these vinyl monomers with each other or with other vinyl monomers (e.g., sodium methacrylate, ammonium methacrylate, Sumicagel L-5H (produced by Sumitomo Chemical Co., Ltd.)) can be used.

Preferred among the water-soluble synthetic polymers which can be used in the present invention are polyvinyl alcohols.

These polyvinyl alcohols will be further described below. Examples of fully-saponified polyvinyl alcohols include PVA-105 [polyvinyl alcohol (PVA) content: 94.0% by mass or more; percent saponification: 98.5±0.5 mol-%; sodium acetate content: 1.5% by mass or less; volatile content: 5.0% by mass or less; viscosity (4% by mass, 20° C.): 5.6±0.4 CPS], PVA-110 [PVA content: 94.0% bymass; percent saponification: 98.5±0.5 mol-%; sodium acetate content: 1.5% by mass; volatile content: 5.0% by mass; viscosity (4% by mass, 20° C.): 11.0±0.8 CPS], PVA-117 [PVA content: 94.0% by mass; percent saponification: 98.5±0.5 mol-%; sodium acetate content: 1.0% by mass; volatile content: 5.0% by mass; viscosity (4% by mass, 20° C.): 28.0±3.0 CPS], PVA-117H [PVA content: 93.5% by mass; percent saponification: 99.6±0.3 mol-%; sodium acetate content: 1.85% by mass; volatile content: 5.0% by mass; viscosity (4% by mass, 20° C.): 29.0±3.0 CPS), PVA-120 [PVA content: 94.0% by mass; percent saponification: 98.5±0.5 mol-%; sodium acetate content: 1.0% by mass; volatile content: 5.0% by mass; viscosity (4% by mass, 20° C.): 39.5±4.5 CPS], PVA-124 [PVA content: 94.0% by mass; percent saponification: 98.5±0.5 mol-%; sodium acetate content: 1.0% by mass; volatile content: 5.0% by mass; viscosity (4% by mass, 20° C.): 60.0±6.0 CPS], PVA-124 [PVA content: 93.5% by mass; percent saponification: 99.6±0.3 mol-%; sodium acetate content: 1.85% by mass; volatile content: 5.0% by mass; viscosity (4% by mass, 20° C.): 61.0±6.0 CPS], PVA-CS [PVA content: 94.0% by mass; percent saponification: 97.5±0.5 mol-%; sodium acetate content: 1.0% by mass; volatile content: 5.0% by mass; viscosity (4% by mass, 20° C.): 27.5±3.0 CPS], PVA-CST [PVA content: 94.0% by mass, percent saponification: 96.0±0.5 mol-%; sodium acetate content: 1.0% by mass; volatile content: 5.0% by mass; viscosity (4% by mass, 20° C.): 27.0±3.0 CPS], and PVA-HC [PVA content: 90.0% by mass; percent saponification: 99.85 mol-% or more; sodium acetate content: 2.5% by mass; volatile content: 8.5% by mass; viscosity (4% by mass, 20° C.): 25.0±3.5 CPS] (All these products are commercially available from KURARAY CO., LTD.).

Examples of partially-saponified polyvinyl alcohols include PVA-203 [PVA content: 94.0% by mass; percent saponification: 88.0±1.5 mol-%; sodium acetate content: 1.0% by mass; volatile content: 5.0% by mass; viscosity (4% by mass, 20° C.): 3.4±0.2 CPS], PVA-204 [PVA content: 94.0% by mass; percent saponification: 88.0±1.5 mol-%; sodium acetate content: 1.0% by mass; volatile content: 5.0% by mass; viscosity (4% by mass, 20° C.): 3.9±0.3 CPS], PVA-205 [PVA content: 94.0% by mass; percent saponification: 88.0±1.5 mol-%; sodium acetate content: 1.0% by mass; volatile content: 5.0% by mass; viscosity (4% by mass, 20° C.): 5.0±0.4 CPS], PVA-210 [PVA content: 94.0% by mass; percent saponification: 88.0±1.0 mol-%; sodium acetate content; 1.0% by mass; volatile content: 5.0% by mass; viscosity (4% by mass, 20° C.): 9.0±1.0 CPS], PVA-217 [PVA content: 94.0% by mass; percent saponification: 88.0±1.0 mol-%; sodium acetate content: 1.0% by mass; volatile content: 5.0% by mass; viscosity (4% by mass, 20° C.): 22.5±2.0 CPS], PVA-220 [PVA content: 94.0% by mass; percent saponification: 88.0±1.0 mol-%; sodium acetate content: 1.0% by mass; volatile content: 5.0% by mass; viscosity (4% by mass, 20° C.): 30.0±3.0 CPS], PVA-224 [PVA content: 94.0% by mass; percent saponification: 88.0±1.5 mol-%; sodium acetate content: 1.0% by mass; volatile content: 5.0% by mass; viscosity (4% by mass, 20° C.): 44.0±4.0 CPS], PVA-228 [PVA content: 94.0% by mass; percent saponification: 88.0±1.5 mol-%; sodium acetate content: 1.0% by mass; volatile content: 5.0% by mass; viscosity (4% by mass, 20° C.): 65.0±5.0 CPS], PVA-235 [PVA content: 94.0% by mass; percent saponification: 88.0±1.5 mol-%; sodium acetate content: 1.0% by mass; volatile content: 5.0% by mass; viscosity (4% by mass, 20° C.): 95.0±15.0 CPS], PVA-217EE [PVA content: 94.0% by mass; percent saponification: 88.0±1.0 mol-%; sodium acetate content: 1.0% by mass; volatile content: 5.0% by mass; viscosity (4% by mass, 20° C.): 23.0±3.0 CPS], PVA-217E [PVA content: 94.0% by mass; percent saponification: 88.0±1.0 mol-%; sodium acetate content: 1.0% by mass; volatile content: 5.0% by mass; viscosity (4% by mass, 20° C.): 23.0±3.0 CPS], PVA-220E [PVA content: 94.0% by mass; percent saponification: 88.0±1.0 mol-%; sodium acetate content: 1.0% by mass; volatile content: 5.0% by mass; viscosity (4% by mass, 20° C.): 31.0±4.0 CPS], PVA-224E [PVA content: 94.0% by mass; percent saponification: 88.0±1.0 mol-%; sodium acetate content: 1.0% by mass; volatile content: 5.0% by mass; viscosity (4% by mass, 20° C.): 45.0±5.0 CPS], PVA-403 [PVA content: 94.0% by mass; percent saponification: 80.0±1.5 mol-%; sodium acetate content: 1.0% by mass; volatile content: 5.0% by mass; viscosity (4% by mass, 20° C.): 3.1±0.3 CPS], PVA-405 [PVA content: 94.0% by mass; percent saponification: 81.5±1.5 mol-%; sodium acetate content: 1.0% by mass; volatile content: 5.0% by mass; viscosity (4% by mass, 20° C.): 4.8±0.4 CPS], PVA-420 [PVA content: 94.0% by mass; percent saponification: 79.5±1.5 mol-%; sodium acetate content: 1.0% by mass; volatile content: 5.0% by mass], PVA-613 [PVA content: 94.0% by mass; percent saponification: 93.5±1.0 mol-%; sodium acetate content: 1.0% by mass; volatile content: 5.0% by mass; viscosity (4% by mass, 20° C.): 16.5±2.0 CPS], and L-8 [PVA content: 96.0% by mass; percent saponification: 71.0±1.5 mol-%; sodium acetate content: 1.0% by mass (ash content); volatile content: 3.0% by mass; viscosity (4% by mass, 20° C.): 5.4±0.4 CPS]. (All these products are commercially available from KURARAY CO., LTD.).

The aforementioned measurements were obtained according to JISK-6726-1977.

As the modified polyvinyl alcohols there may be used those disclosed in Koichi Nagano et al, "Poval", Kobunshi Kankokai. Examples of these modified polyvinyl alcohols include cation-modified polyvinyl alcohols, anion-modified polyvinyl alcohols, —SH compound-modified polyvinyl alcohols, alkylthio compound-modified polyvinyl alcohols, and silanol-modified polyvinyl alcohols.

Examples of these modified polyvinyl alcohols (modified PVA) include C polymers such as C-118, C-318, C-318-2A, and C-506 (All these products are commercially available from KURARAY CO., LTD.), HL polymers such as HM-12E and HL-1203 (All these products are commercially available from KURARAY CO., LTD.), HM polymers such as HM-03 and HM-N-03 (All these products are commercially available from KURARAY CO., LTD.), K polymers such as KL-118, KL-N-03, KL-506, KM-118T and KM-618 (All these products are commercially available from KURARAY CO., LTD.), M polymers such as M-115 (All these products are commercially available from KURARAY CO., LTD.), MP polymers such as MP-102, MP-202 and MP-203 (All these products are commercially available from KURARAY CO., LTD.), MPK polymers such as MPK-1, MPK-2, MPK-3, MPK-4, MPK-5 and MPK-6 (All these products are commercially available from KURARAY CO., LTD.), R polymers such as R-1130, R2105 and R-2130 (All these products are commercially available from KURARAY CO., LTD.), and V polymers such as V-2250 (All these products are commercially available from KURARAY CO., LTD.)

A polyvinyl alcohol can be viscosity-adjusted or viscosity-stabilized with a slight amount of a solvent or inorganic salt incorporated in its aqueous solution. For the details of these compounds, reference can be made to the above cited references, Koichi Nagano et al, "Poval", Kobunshi Kankokai, pp. 144-154. As a representative example, boric acid can be incorporated in the aqueous solution of polyvinyl alcohol to enhance the surface conditions of the coat layer to advantage. The amount of boric acid to be incorporated in the aqueous solution of polyvinyl alcohol is preferably from 0.01% to 40% by mass based on the amount of polyvinyl alcohol.

The binder which is preferably used in the present invention is transparent or semitransparent and normally colorless. As such a binder there may be used a natural resin, polymer or copolymer, synthetic resin, polymer or copolymer or other film-forming medium. Examples of these binder materials include rubbers, polyvinyl alcohols, hydroxyethyl celluloses, cellulose acetates, cellulose acetate butyrates, polyvinylpyrrolidones, starch, polyacrylic acids, polymethyl methacrylates, polyvinyl chlorides, polymethacrylic acids, styrene-maleic anhydride copolymers, styrene-acrylonitrile copolymers, styrene-butadiene copolymers, polyvinyl acetals (e.g., polyvinyl formal, polyvinyl butyral), polyesters, polyurethanes, phenoxy resins, polyvinylidene chlorides, polyepoxides, polycarbonates, polyvinyl acetates, polyolefins, cellulose esters and polyamides which are water-soluble.

In the present invention, the water-soluble polymers are preferably polyvinyl alcohols or gelatins, most preferably gelatins.

The amount of the water-soluble polymer to be incorporated in the receiving layer is preferably from 1% to 25% by mass, more preferably from 1% to 10% by mass based on the total amount of the receiving layer.

<Crosslinking agent>

The aforementioned water-soluble polymer to be incorporated in the receiving layer is preferably partly or entirely crosslinked with a crosslinking agent.

As such a crosslinking agent, there may be incorporated a plurality of amino groups, carboxyl groups or groups reacting with hydroxyl group in the molecule. The crosslinking agent is properly selected depending on the kind of the water-soluble polymer. The kind of the crosslinking agent is not specifically limited. Crosslinking agents as disclosed in the various method described in T. H. James, "THE THEORY OF THE PHOTOGRAPHIC PROCESS FOURTH EDITION" (Macmillan Publishing Co., Inc.), 1977, pp 77-87, U.S. Pat. No. 4,678,739, 41st column, JP-A-59-116655, JP-A-62-245261, and JP-A-61-18942 can be preferably used in the present invention. Any of inorganic compound crosslinking agents (e.g., chromealum, boricacid, salt thereof) and organic compound crosslinking agents are desirable. Alternatively, a crosslinking agent comprising a mixed aqueous solution containing a chelating agent having a pH value of from 1 to 7 and a zirconium compound described in JP-A-2003-231775 may be used.

Specific examples of the crosslinking agent employable herein include epoxy-based compounds (e.g., diglycidylethyl ether, ethylene glycol diglycidyl ether, 1,4-butanediol diglycidyl ether, 1,6-diglycidyl cyclohexane, N,N-diglycidyl-4-glycidyloxyaniline, sorbitol polyglycidyl ether, glycerol polyglycidyl ether, compounds disclosed in JP-A-6-329877 and JP-A-7-309954, Dick Fine EM-60 (trade name; produced by DAINIPPON INK AND CHEMICALS, INCORPORATED), aldehyde-based compounds (e.g., formaldehyde, glyoxal, glutaraldehyde), active halogen-based compounds (e.g., 2,4-dichloro-4-hydroxy-1,3,5-s-triazine, compounds disclosed in U.S. Pat. No. 3,325,287), active vinyl-based compounds (e.g., 1,3,5-trisacryloyl-hexahydro-s-triazine, bisvinylsulfonyl methyl ether, N,N'-ethylene-bis(vinylsulfonyl acetamide)ethane, compounds disclosed in JP-B-53-41220, JP-B-53-57257, JP-B-59-162546 and JP-B-60-80846), mucohalogenic acid compounds (e.g., mucochloric acid), N-carbamoyl pyridinium salt compounds ((1-morpholinocarbonyl-3-pyridinio)methanesulfonate), haloaminium salt compounds (e.g., 1-(1-chloro-1-pyridinomethylene)pyrolidinium, 2-naphthalenesulfonate), N-methylol-based compounds (e.g., dimethylolurea, methylol dimethyl hydantoin), carbodiimide compounds (e.g., isophoronediisocyanate-derived polycarbodiimides disclosed in JP-A-59-187029 and JP-B-5-27450, tetramethyl xylylene diisocyanate-derived carbodiimide compounds disclosed in JP-A-7-330849, multibranched carbodiimide compounds disclosed in JP-A-10-30024, dicyclohexylmethane diisocyanate-derived carbodiimide compounds disclosed in JP-A-2000-7642, Carbodilite V-02, V-02-L2, V-04, V-06, E-01 and E-02 (All these products are commercially available from Nisshinbo Industries, Inc.), oxazoline compounds (e.g., oxazoline compounds disclosed in JP-A-2001-215653, EPOCROS K-1010E, K-1020E, K-1030E, K-2010E, K-2020E, K-2030E, WS-500 and WS-700 (All these products are commercially available from NIPPON SHOKUBAI CO., LTD.), isocyanate compounds (e.g., dispersible isocyanate compounds disclosed in JP-A-7-304841, JP-A-8-277315, JP-A-10-45866, JP-A-9-71720, JP-A-9-328654, JP-A-9-104814, JP-A-2000-194045, JP-A-2000-194237 and JP-A-2003-64149, Duranate WB40-100, WB40-80D, WT20-100, WT30-100 (All these products are commercially available from Asahi Kasei Corporation), CR-60N (trade name; produced by DAINIPPON INK AND CHEMICALS, INCORPORATED)), polymer hardeners (e.g., compounds disclosed in JP-A-62-234157), boric acid and salt thereof, borax, and aluminum alum.

Preferred examples of the crosslinking agent employable herein include epoxy-based compounds, aldehyde-based compounds, active halogen-based compounds, active vinyl-based compounds, N-carbamoyl pyridinium salt compounds, N-methylol-based compounds (e.g., dimethylolurea, methylol dimethyl hydantoin), carbodiimide compounds, oxazoline compounds, isocyanate compounds, polymer hardeners (e.g., compounds disclosed in JP-A-62-234157), boric acid and salt thereof, borax, and aluminum alum. More desirable among these crosslinking agents are epoxy-based compounds, active halogen-based compounds, active vinyl-based compounds, N-carbamoyl pyridinium salt compounds, N-methylol-based compounds (e.g., dimethylolurea, methylol dimethyl hydantoin), polymer hardeners (e.g., compounds disclosed in JP-A-62-234157), and boric acid. These crosslinking agents may be used singly or in combination of two or more thereof.

The crosslinking agent may be incorporated in the form of mixture with the water-soluble polymer solution or may be incorporated at the last stage during the preparation of the coating solution or shortly before the spreading of the coating solution.

Though depending on the kind of the crosslinking agent is used, the water-soluble polymer in the receiving layer is preferably crosslinked in a proportion of from 0.1% to 20% by mass, more preferably from 1% to 10% by mass based on the amount of the water-soluble polymer.

The amount of the crosslinking agent to be used in the present invention depends on the kind of the water-soluble polymer or crosslinking agent but is normally preferably from 0.1 to 50 parts by mass, more preferably from 0.5 to 20 parts by mass, even more preferably from 1 to 10 parts by mass based on 100 parts by mass of the water-soluble polymer in the constituent layer contained.

<Ultraviolet Absorber>

The receiving layer may comprise an ultraviolet absorber incorporated therein to enhance the light-resistance of the heat-sensitive transfer image-receiving sheet. In this case, the ultraviolet absorber can be polymerized so that it can be fixed to the receiving layer, making it possible to prevent itself from being diffused in the ink sheet or sublimated or evaporated when heated.

As the ultraviolet absorber there may be used a compound having various ultraviolet absorber skeletons known widely in the art of data recording. Specific examples of such a compound include compounds having 2-hydroxybenzotriazole type ultraviolet absorber skeleton, 2-hydroxybenzotriazole type ultraviolet absorber skeleton and 2-hydroxybenzophenone type ultraviolet absorber skeleton. From the standpoint of ultraviolet absorbing properties (absorptivity coefficient) and stability, compounds having benzotriazole type and triazine type skeletons are desirable. From the standpoint of polymerization and latex formation, compounds having benzotriazole type and benzophenone type skeletons are desirable. In some detail, ultraviolet absorbers disclosed in JP-A-2004-361936 can be used.

The ultraviolet absorber to be used herein preferably has absorption in the ultraviolet range. Further, the edge of absorption preferably doesn't extend to the visible light range. In some detail, when the ultraviolet absorber is incorporated in the receiving layer to prepare a heat-sensitive transfer image-receiving sheet, the heat-sensitive transfer image-receiving sheet preferably exhibits a reflection density of Abs 0.5 or more at 370 nm, more preferably Abs 0.5 or more at 380 nm. It is also desirable that the reflection density at 400 nm be Abs 0.1 or less. When the reflection density at higher than 400 nm is high, the resulting image is tinged with yellow to disadvantage.

The ultraviolet absorber to be used in the present invention is preferably polymerized. The weight-average molecular weight of the ultraviolet absorber is preferably 10,000 or more, more preferably 100,000 or more. As a method for polymerizing the ultraviolet absorber there is preferably employed a method which comprises grafting the ultraviolet absorber on a polymer. The polymer which is used as a main chain preferably has a polymer skeleton having a poorer dyeing property than the receptive polymer used in combination therewith. The film formed by the polymer preferably has a sufficient strength. The percent grafting of the ultraviolet absorber on the polymer main chain is preferably from 5% to 20% by mass, more preferably from 8% to 15% by mass.

The polymer having an ultraviolet absorber grafted thereon is more preferably latexed. The latexing of the polymer makes it possible to form a receiving layer when an aqueous dispersion-based coating solution is spread and reduce the production cost. As a latexing method there may be used a method disclosed in Japanese Patent No. 3,450,339. As a latexed ultraviolet absorber there may be also used a commercially available ultraviolet absorber such as ULS-700, ULS-1700, ULS-1383MA, ULS-1635MH, XL-7016, ULS-933LP and ULS-935LH (All these products are available from Ipposha oil Industries Co., Ltd.), and New Coat UVA-1025W, New Coat UVA-204W and New Coat UVA-4512M (All these products are available from Shin-nakamura Chemical Corporation).

In order to latex the polymer having an ultraviolet absorber grafted thereon, it can be mixed with a latex of the aforementioned dyable receptive polymer before being spread to form a receiving layer having an ultraviolet absorber dispersed uniformly therein.

The added amount of the polymer having an ultraviolet absorber grafted thereon or its latex is preferably from 5 to 50 parts by mass, more preferably from 10 to 30 parts by mass based on the amount of the dyable receptive polymer latex constituting the receiving layer.

<Release Agent>

The receiving layer may also comprise a release agent incorporated therein to prevent the heat fusion to the ink sheet during image formation. As such a release agent there may be used a silicone oil or phosphoric acid ester-based plasticizer or fluorine-based compound. A silicone oil is particularly preferably used. As such a silicone oil there is preferably used a modified silicone oil such as epoxy-modified silicone oil, alkyl-modified silicone oil, amino-modified silicone oil, carboxyl-modified silicone oil, alcohol-modified silicone oil, fluorine-modified silicone oil, alkyl aralkyl polyether-modified silicone oil, epoxy-polyether-modified silicone oil and polyether-modified silicone oil. In particular, a reaction product of a vinyl-modified silicone oil and a hydrogen-modified silicone oil is desirable. The amount of the release agent to be incorporated in the receiving layer is preferably from 0.2 to 30 parts by mass based on the amount of the receptive polymer.

The spread of the receiving layer is preferably from 0.5 to 10 g/m$^2$ (The spread will be represented in terms of solid content hereinafter unless otherwise specified). The thickness of the receiving layer is preferably from 1 μm to 20 μm.

(Heat Insulating Layer)

The heat insulating layer acts to protect the support against heat developed during transfer under heating using a thermal head. Further, the heat insulating layer has a high cushioning effect and thus can form a heat-sensitive transfer image-receiving sheet having a high printing sensitivity even when paper is used as a support. The heat insulating layer may be composed of single layer or two or more layers. The heat insulating layer is provided closer to the support than the receiving layer.

In the image-receiving sheet of the present invention, the heat insulating layer contains a hollow polymer.

The hollow polymer in the present invention is a particulate polymer having a closed-cell pore in the interior thereof. Examples of such a hollow polymer include 1) non-foaming type hollow particle having water encapsulated inside a wall formed by a polystyrene, acrylic resin, styrene-acryl resin or the like which allows water in the interior thereof to be evaporated out of the particle to make the interior of the particle hollow when spread and dried, 2) foaming type microballoon having a low boiling liquid such as butane and pentane covered by any or a mixture of polymer of polyvinylidene chloride, polyacrylonitrile, polyacrylic acid and polyacrylic acid ester which allows the low boiling liquid in the interior thereof to foam to make the interior of the particle hollow when spread and heated, and 3) microballoon obtained by previously heating the microballoon (2) so that it foams to form a hollow polymer.

These hollow polymers preferably have a void of from about 20% to 70%. Two or more of these hollow polymers may be used in admixture as necessary. Specific examples of the aforementioned hollow polymer (1) include ROHPAC 1055 (produced by Rohm and Haas Company), Voncoat PP-1000 (produced by DAINIPPON INK AND CHEMICALS, INCORPORATED), SX866 (B) (produced by JSR Co., Ltd.), and Nipol MH5055 (produced by ZEON CORPORATION) (All these products are represented by trade name) Specific examples of the aforementioned hollow polymer (2) include F-30 and F-50 (produced by Matsumoto Yushi-Seiyaku Co., Ltd.) (All these products are represented by trade name) Specific examples of the aforementioned hollow polymer (3) include F-30E (produced by Matsumoto Yushi-Seiyaku Co., Ltd.), and Expancel 461DE, 551DE and 551DE20 (produced by Nippon Ferrite Co , Ltd.) (All these products are represented by trade name). The hollow polymer to be incorporated in the heat insulating layer may be latexed.

The heat insulating layer containing a hollow polymer preferably comprises a water-dispersible resin or water-soluble resin incorporated therein as a binder resin. Examples of the binder resin employable herein include known resins such as acrylic resin, styrene-acryl copolymer, polystyrene resin, polyvinyl alcohol resin, vinyl acetate resin, ethylene-vinyl acetate copolymer, vinyl chloride-vinyl acetate copolymer, styrene-butadiene copolymer, polyvinylidene chloride resin, cellulose derivative, casein, starch and gelatin. These resins may be used singly or in admixture.

The solid content of the hollow polymer in the heat insulating layer is preferably from 5 to 2,000 parts by mass when the solid content of the binder resin is 100 parts by mass. The weight proportion of the solid content of the hollow polymer in the coating solution is preferably from 1% to 70% by mass, more preferably from 10% to 40% by mass. When the weight proportion of the hollow polymer is too small, it may be the case where sufficient heat insulation cannot be attained. On the other hand, when the weight proportion of the hollow polymer is too great, it may be the case where the bonding force between the hollow polymer particles can be lowered, causing dusting or film exfoliation during treatment.

The particle size of the hollow polymer is preferably from 0.1 μm to 20 μm, more preferably from 0.1 μm to 2 μm, particularly preferably from 0.1 μm to 1 μm. The glass transition temperature (Tg) of the hollow polymer is preferably 70° C. or more, more preferably 100° C. or more.

In the image-receiving sheet of the present invention, the heat insulating layer is free of a resin having no resistance to organic solvent besides the hollow polymer. When the heat insulating layer contains a resin having no resistance to organic solvent (dyable resin), it causes enhanced image bleeding after image transfer to disadvantage. This is presumably because when a dyable resin and a hollow polymer are incorporated in the heat insulating layer, the dye which has been attached to the receiving layer moves through the adjacent heat insulating layer with time after transfer.

The term "having no resistance to organic solvent" as used herein is meant to indicate that the solubility in an organic solvent (e.g., methyl ethyl ketone, ethyl acetate, benzene, toluene, xylene) is 1% by mass or less, preferably 0.5% by mass or less at 25° C. For example, the aforementioned polymer latex is included in the category of "resins having no resistance to organic solvent".

Further, the heat insulating layer preferably comprises the aforementioned water-soluble polymer incorporated therein. Examples of such a compound which is preferably used herein include those exemplified above with respect to water-soluble polymer.

The amount of the water-soluble polymer to be incorporated in the heat insulating layer is preferably from 1% to 75% by mass, more preferably from 1% to 50% by mass based on the total amount of the heat insulating layer.

The heat insulating layer preferably comprises gelatin incorporated therein. The proportion of gelatin in the coating solution of the heat insulating layer is preferably from 0.5% to 14% by mass, particularly preferably from 1% to 6% by mass. The spread of the aforementioned hollow polymer in the heat insulating layer is preferably from 1 to 100 g/m$^2$, more preferably from 5 to 20 g/m$^2$.

The water-soluble polymer to be incorporated in the heat insulating layer is preferably crosslinked with a crosslinking agent. The crosslinking agent which is preferably used herein and the preferred range of the amount thereof are the same as defined previously.

Though depending on the kind of the crosslinking agent is used, the water-soluble polymer in the heat insulating layer is preferably crosslinked in a proportion of from 0.1% to 20% by mass, more preferably from 1% to 10% by mass based on the amount of the water-soluble polymer.

The thickness of the heat insulating layer containing a hollow polymer is preferably from 5 μm to 50 μm, more preferably from 5 μm to 40 μm.

(Underlayer)

An underlayer may be formed between the receiving layer and the heat insulating layer. For example, a whiteness adjusting layer, charge adjusting layer, adhesive layer and primer layer are formed. These layers may have the same configuration as described in Japanese Patent No. 3585599 and Japanese Patent No. 2925244.

(Support)

In the present invention, the support preferably has a water resistance. The use of such a water-resistant support makes it possible to prevent the support from absorbing water content and prevent the change of properties of the receiving layer with time. As the water-resistant support of the present invention there may be used a coated paper or laminated paper.

<Coated Paper>

The aforementioned coated paper is obtained by coating a sheet such as raw paper with various resins, rubber latexes or polymer materials on one or both sides thereof. The spread amount of these coating compounds depends on the purpose. Examples of such a coated paper include art paper, cast-coated paper, and Yankee paper.

As the resin to be spread over the surface of the raw paper there is preferably used a thermoplastic resin. Examples of such a thermoplastic resin include the following thermoplastic resin (a) to (h).

(a) Copolymers of polyolefin resin such as polyethylene resin and polypropylene resin or olefin such as ethylene and propylene with other vinyl monomers, acrylic resins, etc.

(b) Thermoplastic resins having ester bond. Examples of such thermoplastic resins include polyester resins obtained by the condensation of dicarboxylic acid component (which may be substituted by sulfonic acid group, carboxyl group or the like) with alcohol component (which may be substituted by hydroxyl group or the like), polyacrylic acid ester resins or polymethacrylic acid ester resins such as polymethyl methacrylate, polybutyl methacrylate, polymethyl acrylate and polybutyl acrylate, polycarbonate resins, polyvinyl acetate resins, styrene acrylate resins, styrene-methacrylic acid ester copolymer resins, and vinyltoluene acrylate resins.

Specific examples of these thermoplastic resins include those disclosed in JP-A-59-101395, JP-A-63-7971, JP-A-63-7972, JP-A-63-7973, and JP-A-60-294862.

Examples of commercially available thermoplastic resins include VYLON 290, VYLON 200, VYLON 280, VYLON 300, VYLON 103, VYLON GK-140 and VYLON GK-130 (produced by (produced by TOYOBO CO., LTD.), Toughton NE-382, Toughton U-5, ATR-2009 and ART-2010 (produced by Kao Corporation), Elitel UE3500, UE3210, XA-8153, KZA-7049 and KZA-1449 (produced by UNITIKA LTD.), Polyestar TP-220 and R-188 (produced by Nippon Synthetic Chemical Industry Ltd.), and various thermoplastic resins of Hi-Ros Series produced by SEIKO PMC CORPORATION).

(c) Polyurethane resins, etc.

(d) Polyamide resins, urea resins, etc.

(e) Polysulfone resins, etc.

(f) Polyvinyl chloride resins, polyvinylidene chloride resins, vinyl chloride-vinyl acetate copolymer resins, vinyl chloride-vinyl propionate copolymer resins, etc.

(g) Polyol resins such as polyvinyl butyral, cellulose resins such as ethyl cellulose resin and cellulose acetate resins, etc.

(h) Polycaprolactone resins, styrene-maleic anhydride resins, polyacrylonitrile resins, polyether resins, epoxy resins, phenolic resins, etc.

The aforementioned thermoplastic resins may be used singly or in combination of two or more thereof.

The thermoplastic resins may optionally comprise a brightening agent, an electrically-conducting agent, a filler, a pigment or dye such as titanium oxide, ultramarine and carbon black or the like incorporated therein.

<Laminated Paper>

The aforementioned laminated paper is obtained by laminating various resins, rubbers, polymer sheets or films on a sheet such as raw paper. Examples of the aforementioned laminating materials employable herein include polyolefins, polyvinyl chlorides, polyethylene terephthalates, polystyrenes, polymethacrylates, polycarbonates, polyimides, and triacetyl celluloses. These resins may be used singly or in combination of two or more thereof.

The aforementioned polyolefin is often normally formed by a low density polyethylene. In order to enhance the heat resistance of the support, a polypropylene, a blend of polypropylene and polyethylene, a high density polyethylene, a blend of high density polyethylene and low density polyethylene or the like is preferably used. From the standpoint of cost, laminatability, etc. in particular, a blend of high density polyethylene and low density polyethylene is most desirable.

In the blend of high density polyethylene and low density polyethylene, the high density polyethylene and the low density are blended at a ratio of from 1/9 to 9/1, preferably from 2/8 to 8/2, more preferably from 3/7 to 7/3 (by weight). In the case where the thermoplastic resin layer is formed on the both sides of the support, the back side of the support is preferably formed by a high density polyethylene or a blend of a high density polyethylene and a low density polyethylene. The molecular weight of the polyethylene is not specifically limited. However, whichever it is a high density polyethylene or low density polyethylene, the polyethylene preferably has a melt index of from 1.0 to 40 g/10 minutes and a good extrudability.

These sheets or films may be treated to have white reflectivity. Examples of such treatment include a method involving the incorporation of a pigment such as titanium oxide in these sheets or films.

The thickness of the aforementioned support is preferably from 25 μm to 300 μm, more preferably from 50 μm to 260 μm, even more preferably from 75 μm to 220 μm. The rigidity of the support may vary depending on the purpose. As the support for electrophotographic image-receiving sheet for photographic image quality there is preferably used one similar to the support for color silver salt photograph.

(Curl Adjusting Layer)

When the support is exposed as it is, the heat-sensitive transfer image-receiving sheet can be curled due to moisture and heat in the atmosphere. Therefore, the support preferably has a curl adjusting layer formed on the back side thereof. The curl adjusting layer acts to not only prevent the curling of the image-receiving sheet but also protect the image-receiving sheet against water. As the curl adjusting layer there is used a polyethylene laminate, polypropylene laminate or the like. In some detail, the curl adjusting layer can be formed in the same manner as described in JP-A-61-110135, JP-A-6-202295, etc.

(Writing Layer, Charge Adjusting Layer)

The writing layer/charge adjusting layer can be made of an inorganic oxide colloid, ionic polymer or the like. As an antistatic agent there may be used any of cationic antistatic agents such as quaternary ammonium salt and polyamine derivative, anionic antistatic agents such as alkyl phosphate and nonionic antistatic agents such as aliphatic acid ester. In some detail, the writing layer/charge adjusting layer can be formed in the same manner as described in Japanese Patent No. 3,585,585, etc.

(Method for Producing Heat-Sensitive Transfer Image-Receiving Sheet)

The method for producing a heat-sensitive transfer image-receiving sheet of the present invention will be described hereinafter.

The heat-sensitive transfer image-receiving sheet of the present invention can be prepared by spreading the various layer coating solutions by an ordinary method such as roll coating method, bar coating method, gravure coating method and gravure reverse coating method, and then drying the various coat layers.

The heat-sensitive transfer image-receiving sheet of the present can be prepared also by simultaneously spreading the receiving layer coating solution and the heat insulating layer coating solution over a support.

In the case where a multi-layer image-receiving sheet composed of a plurality of layers having different functions (e.g., foam layer, heat insulating layer, interlayer, receiving layer) is formed on the support, a method is known which comprises successively spreading the various layer coating solutions over the support or laminating supports having the respective layer coating solution spread thereon on each other as disclosed in. JP-A-2004-106283, JP-A-2004-181888, JP-A-2004-345267, etc. In the art of photography, on the other hand, a method is known which comprises simultaneously spreading a plurality of layer coating solutions to drastically enhance productivity. So-called slide coating method and curtain coating method are known as disclosed in U.S. Pat. Nos. 2,761,791, 2,681,234, 3,508,947, 4,457,256 and 3,993,019, JP-A-63-54975, JP-A-61-278848, JP-A-55-96557, JP-A-52-31727, JP-A-55-142565, JP-A-50-43140, JP-A-63-80872, JP-A-54-54020, JP-A-5-104061, JP-A-5-127305, JP-B-49-7050, Edgar B. Gutoff et al, "Coating and Drying Defects: Troubleshooting Operating Problems", John Wiley & Sons, 1995, pp. 101-103, etc.

In the present invention, the aforementioned simultaneous multi-layer coating method can be used to produce a multi-layer image-receiving sheet, making it possible to drastically enhance productivity and reduce image defects.

In the present invention, the plurality of layers to be formed on the support are each composed of a resin as a main component. The coating solutions for forming the various layers each are preferably a water-dispersed latex. The solid content of the resin in latex form in the various layer coating solutions is preferably from 5% to 80%, particularly preferably from 20% to 60%. The average particle size of the resin to be incorporated in the aforementioned water-dispersed latex is preferably 5 μm or less, particularly preferably 1 μm or less. The aforementioned water-dispersed latex may comprise any known additives such as surface active agent, dispersant and binder resin incorporated therein as necessary.

In the present invention, a plurality of laminates which have been formed on a support by a method described in U.S. Pat. No. 2,761,791 are then preferably rapidly solidified. For example, in the case where a multilayer structure is formed by the solidification of resins, the formation of the plurality of laminates on the support is immediately followed by the rise of temperature. In the case where the coating solution contains a binder which gels at low temperature such as gelatin, it is also preferred that the formation of the plurality of layer coating solutions be immediately followed by the drop of temperature.

In the present invention, the spread of the coating solution per one of the layers constituting the multilayer structure is preferably from 1 g/m$^2$ to 50 g/m$^2$. The number of layers constituting the multilayer structure is 2 or more and can be arbitrarily predetermined. The receiving layer is preferably provided as a layer farthest from the support.

(Image Forming Method)

In the method for forming an image using a heat-sensitive transfer image-receiving sheet of the present invention, the ink sheet to be used in combination with the aforementioned heat-sensitive transfer image-receiving sheet of the present invention has a dye layer containing a dispersible transfer dye in a support. Any ink sheet may be used. As method for giving a heat energy during heat transfer there may be any known energizing method. For example, by controlling the recording time using a recording device such as thermal printer (e.g., trade name: Video Printer VY-100, produced by Hitachi Limited), a heat energy of from about 5 to 100 mJ/mm$^2$ can be given to attain the desired purpose sufficiently.

(Use)

The heat-sensitive transfer image-receiving sheet of the present invention can comprise a properly selected support so that it can be applied to various uses such as heat-sensitive transfer image-receiving sheets in a sheet or roll form, cards and sheets for transmission type original which can be subjected to heat transfer recording.

The present invention can be used in printers and copying machines utilizing heat-sensitive transfer recording system.

EXAMPLES

The characteristics of the present invention will be further described in the following examples. The materials, added amounts, proportions, treatment conditions, procedural orders, etc. described hereinafter may be properly changed so far as they fall within the essence of the present invention. Accordingly, the scope of the present invention should not be construed as being limited to the following examples.

Example (Preparation of Support)

50 parts by mass of LBKP (leaved bleached kraft pulp) made of acacia and 50 parts by mass of LBKP made of aspen were each beaten to a Canadian standard freeness of 300 ml using a disc refiner to prepare a pulp slurry.

Subsequently, to the pulp slurry thus obtained were added a cation-modified starch (CAT0304L, produced by NIPPON NSC CO., LTD.), an anionic polyacrylamide (DA4104, produced by SEIKO PMC CORPORATION), an alkyl ketene dimer (Sizepine K, produced by Arakawa Chemical Industries, Ltd.), an epoxylated behenic acid amide and a polyamide polyamine epichlorohydrin (Arafix 100, produced by Arakawa Chemical Industries, Ltd.) in an amount of 1.3%, 0.15%, 0.29%, 0.29% and 0.32%, respectively, based on the amount of the pulp. To the mixture was then added an anti-foaming agent in an amount of 0.12% based on the amount of the pulp.

The pulp slurry thus prepared was then subjected to paper making using a wire paper machine. The web thus prepared was then pressed against a drum dryer cylinder on the felt surface thereof with a dryer canvass interposed therebetween so that it was dried. During this drying procedure, the tensile force of the dryer canvass was predetermined to be 1.6 kg/cm. Thereafter, a polyvinyl alcohol (KL-118, produced by KURARAY CO., LTD.) was spread over the both sides of the raw paper at a spread of 1 g/m$^2$ using a size press, dried, and then calendered. During paper making, the basis weight was predetermined to be 157 g/m$^2$. Thus, a raw paper (base paper) having a thickness of 160 μm was obtained.

The base paper thus obtained was then subjected to corona discharge treatment on the wire surface (back surface) thereof. Using a melt extruder, a resin composition obtained by mixing a high density polyethylene having MFR (hereinafter meaning melt flow rate) of 16.0 g/10 min and a density of 0.96 g/cm$^3$ (containing 250 ppm of hydrotalcite (trade name: DHT-4A, produced by Kyowa Chemistry Industry Co., Ltd.) and 200 ppm of a secondary oxidation inhibitor (tris(2,4-di-t-butylphenyl) phosphite (trade name: Irgafos 168, produced by Ciba Specialty Chemicals Co., Ltd.)) and a low density polyethylene having MFR of 4.0 g/10 min and a density of 0.93 g/cm$^3$ at a ratio of 75/25 (by mass) was spread over the back surface of the base paper to a thickness of 21 g/m$^2$ to form a thermoplastic resin layer made of mat surface (hereinafter, this thermoplastic resin layer surface will be referred to as "back surface"). The thermoplastic resin layer on the back surface of the base paper was then subjected to corona discharge treatment. Thereafter, a dispersion obtained by dispersing aluminum oxide (Aluminasil 100, produced by NISSAN CHEMICAL INDUSTRIES, LTD.) and silicate dioxide (Snowtex O, produced by NISSAN CHEMICAL INDUSTRIES, LTD.) in water at a ratio of 1:2 by mass was spread over the thermoplastic resin layer in such an amount that the dried mass reached 0.2 g/m$^2$. Subsequently, the base paper was subjected to corona treatment on the front surface thereof. Using a melt extruder, a low density polyethylene having MFR of 4.0 g/10 min and a density of 0.93 g/m$^2$ containing 10% by mass of titanium oxide was then spread over the corona-treated surface of the base paper at a spread of 27 g/m$^2$ to form a thermoplastic resin layer made of mirror surface.

(Preparation of Emulsion A)

An emulsion dispersion was prepared in the following manner. The following compound A-6 was dissolved in a mixture of 42 g of a high boiling solvent (Solv-1 shown below) and 20 ml of ethyl acetate. The solution thus obtained was emulsified and dispersed in 250 g of a 20 wt-% aqueous solution of gelatin containing 1 g of sodium dodecylbenzenesulfonate using a high speed agitated emulsifier (Dissolver). To the dispersion was then added water to prepare 380 g of an emulsion A. During this procedure, the amount of the compound A-6 to be added was adjusted to be 30 mmol in the emulsion A.

A-6

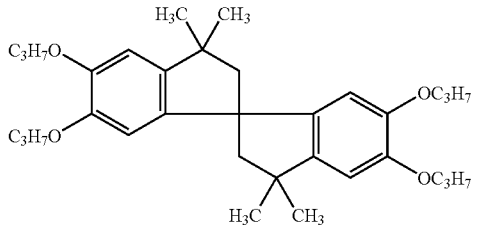

Solv-1

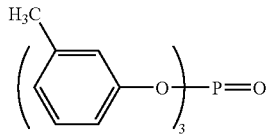

(Preparation of Image-Receiving Sheet)

Samples 101 to 106 were each prepared by simultaneously spreading the various layer coating solutions in such an arrangement that an undercoating layer 1, an undercoating layer 2 and an image-receiving layer 3 were formed in this order on a support. During the simultaneous multi-layer coating process, the spread of the undercoating layers 1 and 2 were each adjusted to be 11 ml/m$^2$ and the spread of the receiving layer was adjusted to be 18 ml/m$^2$. Samples 107 to 112 were each prepared by simultaneously spreading the various layer coating solutions in such an arrangement that an undercoating layer 1, an undercoating layer 2, a heat insulating layer and an image-receiving layer 4 were formed in this order on a support. The spread of the heat insulating layer was adjusted to be 45 ml/m$^2$. The spread of the other layers were adjusted to be the same as in Samples 101 to 106. The formulation of the various coating solutions will be given below.

<Coating Solution for Undercoating Layer 1>

Aqueous solution obtained by adding 1% of sodium dodecylbenzenesulfonate to a 3% aqueous solution of gelatin and adjusting pH thereof to 8 with NaOH

| <Coating solution for undercoating layer 2> | |
|---|---|
| Styrenebutane diene latex (SR103, produced by L&L Products of Japan Inc.) | 60 parts by mass |
| 6% aqueous solution of PVA | 40 parts by mass |
| NaOH | to make pH8 |
| **<Coating solution for heat insulating layer>** | |
| Hollow polymer latex (produced by ZEON CORPORATION) | 60 parts by mass |
| 10% aqueous solution of gelatin | 20 parts by mass |
| Emulsion A shown above | 20 parts by mass |
| NaOH | to make pH8 |
| **<Coating solution for receiving layer>** | |
| Polymer latex of the kind set forth in Table 1 | 70 parts by mass |
| 10% aqueous solution of gelatin | 10 parts by mass |
| Emulsion A shown above | 10 parts by mass |
| Microcrystalline wax (EMUSTAR-42X, produced by NIPPON SEIRO CO., LTD) | 5 parts by mass |
| Water | 5 parts by mass |
| NaOH | to make pH8 |

Test Examples (Preparation of Ink Sheet)

A polyester film having a thickness of 6.0 μm (Lumirror (trade name), produced by Toray Industries, Ltd.) was used as a support. A heat-resistant slip layer (thickness: 1 μm) was formed on the back surface of the film. A yellow coating solution, a magenta coating solution and a cyan coating solution having the following formulations were each monochromatically spread over the front surface of the film (dried spread: 1 g/m$^2$) to prepare an ink sheet.

| <Yellow coating solution> | |
|---|---|
| Dye (MACROLEX YELLOW 6G (trade name), produced by Bayer Japan Co., Ltd.) | 5.5 parts by mass |
| Polyvinyl butyral resin (S-LEX BX-1 (trade name), produced by SEKISUI CHEMICAL CO., LTD.) | 4.5 parts by mass |
| Methyl ethyl ketone/toluene (weight ratio: 1/1) | 90 parts by mass |
| **<Magenta coating solution>** | |
| Magenta dye (Disperse Red 60) | 5.5 parts by mass |
| Polyvinyl butyral resin (S-LEX BX-1 (trade name), produced by SEKISUI CHEMICAL CO., LTD.) | 4.5 parts by mass |
| Methyl ethyl ketone/toluene (weight ratio: 1/1) | 90 parts by mass |
| **<Cyan coating solution>** | |
| Cyan dye (Solvent Blue 63) | 5.5 parts by mass |
| Polyvinyl butyral resin (S-LEX BX-1 (trade name), produced by SEKISUI CHEMICAL CO., LTD.) | 4.5 parts by mass |
| Methyl ethyl ketone/toluene (weight ratio: 1/1) | 90 parts by mass |

(Image Formation)

The aforementioned ink sheet and the aforementioned Samples 101 to 112 were each then worked so as to be loaded in a Type DPB1500 sublimation type printer (produced by Nidec Copal Corporation). With the ink sheet and these samples loaded in the printer, images were then outputted in a high speed print mode under the conditions such that a gray gradation ranging from lowest density to highest density can be obtained. During the image forming process, 13 seconds were required to output one sheet of L size print.

(Evaluation)

(1) Evaluation of Dmax

The black image obtained under the aforementioned conditions was measured for visual density using a photographic densitometer produced by X-Rite Incorporated.

(2) Evaluation of Heat Weldability

The degree of heat welding of the sample to the ink sheet during image printing under the aforementioned conditions was evaluated according to the following criterion.

G (good): No heat welding

F (fair): Partial heat welding

P (poor): Entire heat welding

The results thus obtained are collectively set forth in Table 1 below, As can be seen in Table 1, Samples 110 to 112 of the invention can each attain a remarkably high Dmax as compared with Comparative Samples 101 to 109 and can provide a high quality image free from image defects.

TABLE 1

| Sample No. | Heat insulating layer | Receiving layer: Kind of polymer | Polymer Tg | Mixing mass ratio | Weighted-averaged Tg | Dmax | Heat weldability | Remarks |
|---|---|---|---|---|---|---|---|---|
| 101 | None | VYLONALMD1480 (trade name: TOYOBO CO., LTD.) | 20° C. | 100% | 20° C. | 1.62 | F | Comparative |
| 102 | None | VINYBLAN270 (produced by NISSIN CHEMICAL INDUSTRY CO., LTD.) | −3° C. | 100% | −3° C. | — | P | Comparative |
| 103 | None | VINYBLAN900 (produced by NISSIN CHEMICAL INDUSTRY CO., LTD.) | 70° C. | 100% | 70° C. | 1.68 | G | Comparative |
| 104 | None | VYLONALMD1100 (trade name: TOYOBO CO., LTD.) | 20° C. | 80% | 58° C. | 1.71 | G | Comparative |
| | | VYLONALMD1480 (trade name: TOYOBO CO., LTD.) | 67° C. | 20% | | | | |
| 105 | None | VINYBLAN900 (produced by NISSIN CHEMICAL INDUSTRY CO., LTD.) | 70° C. | 70% | 48° C. | 1.73 | G | Comparative |
| | | VINYBLAN270 (produced by NISSIN CHEMICAL INDUSTRY CO., LTD.) | −3° C. | 30% | | | | |
| 106 | None | VINYBLAN683 (produced by NISSIN CHEMICAL INDUSTRY CO., LTD.) | 72° C. | 70% | 64° C. | 1.73 | G | Comparative |
| | | VINYBLAN609 (produced by NISSIN CHEMICAL INDUSTRY CO., LTD.) | 46° C. | 30% | | | | |
| 107 | Yes | VYLONALMD1480 (trade name: TOYOBO CO., LTD.) | 20° C. | 100% | 20° C. | 2.04 | F | Comparative |
| 108 | Yes | VINYBLAN270 (produced by NISSIN CHEMICAL INDUSTRY CO., LTD.) | −3° C. | 100% | −3° C. | — | P | Comparative |
| 109 | Yes | VINYBLAN900 (produced by NISSIN CHEMICAL INDUSTRY CO., LTD.) | 70° C. | 100% | 70° C. | 2.10 | G | Comparative |
| 110 | Yes | VYLONALMD1100 (trade name: TOYOBO CO., LTD.) | 20° C. | 80% | 58° C. | 2.22 | G | Inventive |
| | | VYLONALMD1480 (trade name: TOYOBO CO., LTD.) | 67° C. | 20% | | | | |
| 111 | Yes | VINYBLAN900 (produced by NISSIN CHEMICAL INDUSTRY CO., LTD.) | 70° C. | 70% | 48° C. | 2.32 | G | Inventive |
| | | VINYBLAN270 (produced by NISSIN CHEMICAL INDUSTRY CO., LTD.) | −3° C. | 30% | | | | |
| 112 | Yes | VINYBLAN683 (produced by NISSIN CHEMICAL INDUSTRY CO., LTD.) | 72° C. | 70% | 64° C. | 2.28 | G | Inventive |
| | | VINYBLAN609 (produced by NISSIN CHEMICAL INDUSTRY CO., LTD.) | 46° C. | 30% | | | | |

Example 2

Samples 101 to 112 of Example 1 were each then worked so as to be loaded in UP-DR150, a sublimation type printer (produced by Sony Corporation). With these samples loaded in the printer, images were then outputted in a high speed print mode under the conditions such that a gray gradation ranging from lowest density to highest density can be obtained. During the image forming process, 8.5 seconds were required to output one sheet of L size print.

These samples were then evaluated in the same manner as in the test example. As a result, Samples 110 to 112 of the invention can each attain a remarkably high Dmax as compared with Comparative Samples 101 to 109 and provide a high quality image free from image defects similarly to the results of Example 1.

The use of the heat-sensitive transfer image-receiving sheet of the invention makes it possible to form a good image having a high density and little image defects in a short time processing. Further, the use of the production method involving a simultaneous multi-layer coating method makes it easy to produce the aforementioned heat-sensitive transfer image-receiving sheet and makes it possible to further eliminate image defects. Accordingly, the invention has a high industrial applicability.

While the present invention has been described in detail and with reference to specific embodiments thereof, it will be apparent to one skilled in the art that various changes and modifications can be made therein without departing from the spirit and scope thereof.

The present disclosure relates to the subject matter contained in Japanese Patent Application No. 051698/2006 filed on Feb. 28, 2006, which is expressly incorporated herein by reference in its entirety. All the publications referred to in the present specification are also expressly incorporated herein by reference in their entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated.

It is intended that the scope of the invention not be limited by the specification, but be defined claims set forth below.

What is claimed is:

1. A heat-sensitive transfer image-receiving sheet comprising at least one receiving layer containing a polymer latex and at least one heat insulating layer containing a hollow polymer on a support, wherein the polymer latex contained in the receiving layer comprises two or more dyeable polymers having different glass transition temperatures;

wherein there are two or more polymer latexes contained in the receiving layer and among the two or more polymer latexes contained in the receiving layer, one polymer latex has a lowest glass transition temperature of 0° C. to 60° C. and another polymer latex has a highest glass transition temperature of 60° C. to 100° C. and, wherein the weighted average glass transition temperature of the two or more polymer latexes contained in the receiving layer is 40° C. to 70° C.

2. The heat-sensitive transfer image-receiving sheet according to claim 1, wherein the receiving layer comprises a latex of a copolymer containing a repeating unit derived from vinyl chloride.

3. The heat-sensitive transfer image-receiving sheet according to claim 1, wherein the heat insulating layer containing a hollow polymer is free of resin having no resistance to organic solvents besides the hollow polymer.

4. The heat-sensitive transfer image-receiving sheet according to claim 1, wherein the receiving layer and/or heat insulating layer comprises a water-soluble polymer.

5. The heat-sensitive transfer image-receiving sheet according to claim 4, wherein the receiving layer and/or heat insulating layer containing a water-soluble polymer contains a compound capable of crosslinking the water-soluble polymer and the water-soluble polymer is partly or entirely crosslinked.

6. A method for producing a heat-sensitive transfer image-receiving sheet comprising simultaneously spreading at least one receiving layer coating solution containing a polymer latex made of two or more dyeable polymers having different glass transition temperatures and at least one heat insulating layer coating solution containing a hollow polymer but free of resin having no resistance to organic solvents excluding the hollow polymer over a support in this order to form at least one receiving layer and at least one heat insulating layer on the support;

wherein among the two or more polymer latexes contained in the receiving layer coating solution, one polymer latex has a lowest glass transition temperature of 0° C. to 60° C. and another polymer latex has a highest glass transition temperature of 60° C. to 100° C. and, wherein the weighted-averaged glass transition temperature of the two or more polymer latexes contained in the receiving layer coating solution is 40° C. to 70° C.

7. A heat-sensitive transfer image-receiving sheet comprising at least one receiving layer containing a polymer latex and at least one heat insulating layer containing a hollow polymer on a support, wherein the polymer latex contained in the receiving layer comprises two or more dyeable polymers having different glass transition temperatures, all of the two or more dyeable polymers being a latex of a copolymer containing a repeating unit derived from vinyl chloride.

8. The heat-sensitive transfer image-receiving sheet according to claim 7, wherein the latex of a copolymer containing a repeating unit derived from vinyl chloride is a latex of vinyl chloride-vinyl acetate copolymer or a latex of vinyl chloride-acryl copolymer.

9. The heat-sensitive transfer image-receiving sheet according to claim 7, wherein the latex of a copolymer containing a repeating unit derived from vinyl chloride is a latex of vinyl chloride-acryl copolymer.

10. The heat-sensitive transfer image-receiving sheet according to claim 7, wherein the receiving layer and/or heat insulating layer comprises a water-soluble polymer.

11. The heat-sensitive transfer image-receiving sheet according to claim 10, wherein the receiving layer and/or heat insulating layer containing a water-soluble polymer contains a compound capable of crosslinking the water-soluble polymer and the water-soluble polymer is partly or entirely crosslinked.

12. A method for producing a heat-sensitive transfer image-receiving sheet comprising simultaneously spreading at least one receiving layer coating solution containing a polymer latex made of two or more dyeable polymers having different glass transition temperatures and at least one heat insulating layer coating solution containing a hollow polymer but free of resin having no resistance to organic solvents excluding the hollow polymer over a support in this order to form at least one receiving layer and at least one heat insulating layer on the support, wherein all of the polymer latex made of two or more dyeable polymers having different glass transition temperatures is a latex of a copolymer containing a repeating unit derived from vinyl chloride.

13. The method for producing a heat-sensitive transfer image-receiving sheet according to claim 12, wherein the latex of a copolymer containing a repeating unit derived from vinyl chloride is a latex of vinyl chloride-vinyl acetate copolymer or a latex of vinyl chloride-acryl copolymer.

14. The method for producing a heat-sensitive transfer image-receiving sheet according to claim 12, wherein the latex of a copolymer containing a repeating unit derived from vinyl chloride is a latex of vinyl chloride-acryl copolymer.

15. The method for producing a heat-sensitive transfer image-receiving sheet according to claim 12, wherein the receiving layer and/or heat insulating layer comprises a water-soluble polymer.

16. The method for producing a heat-sensitive transfer image-receiving sheet according to claim 12, wherein the receiving layer and/or heat insulating layer containing a water-soluble polymer contains a compound capable of crosslinking the water-soluble polymer and the water-soluble polymer is partly or entirely crosslinked.

* * * * *